United States Patent [19]

Coker

[11] 4,437,581

[45] Mar. 20, 1984

[54] PUMP MOTOR MASTER CONTROL

[75] Inventor: William R. Coker, Lilburn, Ga.

[73] Assignee: Nordson Corporation, Amherst, Ohio

[21] Appl. No.: 324,672

[22] Filed: Nov. 27, 1981

[51] Int. Cl.[3] ..... B67D 5/08

[52] U.S. Cl. ..... 222/54; 222/63

[58] Field of Search ..... 222/54, 63, 52, 146 HE; 318/471, 473; 219/421

[56] References Cited

U.S. PATENT DOCUMENTS

| | | | |
|---|---|---|---|
| 3,210,862 | 10/1965 | Lycan . | |
| 3,213,548 | 10/1965 | Deaton . | |
| 3,254,423 | 6/1966 | Ruelle . | |
| 3,318,481 | 5/1967 | Phillips et al. . | |
| 3,323,510 | 6/1967 | McIntyre | 222/54 X |
| 3,492,586 | 1/1970 | Leffmann . | |
| 3,668,497 | 6/1972 | Freiberger | 318/471 |
| 3,702,030 | 11/1972 | Janke . | |
| 3,797,808 | 3/1974 | Ma | 222/63 X |
| 3,894,282 | 7/1975 | MacFarland, Jr. . | |
| 4,059,466 | 11/1977 | Scholl et al. . | |
| 4,059,714 | 11/1977 | Scholl et al. . | |
| 4,083,118 | 4/1978 | Cotton . | |
| 4,086,466 | 4/1978 | Scharlack . | |
| 4,135,122 | 1/1979 | Holmquist et al. . | |
| 4,154,368 | 5/1979 | Gusmer et al. . | |
| 4,209,915 | 7/1980 | Keuleman et al. . | |
| 4,227,062 | 10/1980 | Payne et al. . | |
| 4,233,498 | 11/1980 | Payne et al. . | |
| 4,256,951 | 3/1981 | Payne et al. . | |

*Primary Examiner*—Joseph J. Rolla
*Assistant Examiner*—Kevin P. Shaver
*Attorney, Agent, or Firm*—Wood, Herron & Evans

[57] ABSTRACT

A master control for preventing the operation of a hot melt adhesive pump motor in a hot melt adhesive dispensing system until the adhesive has reached a dispensable molten state. The hot melt adhesive dispensing system includes an adhesive melting tank and a heater for heating the tank, which in turn heats the adhesive. A heater control energizes the heater when the temperature of the tank falls below a predetermined temperature so that, after an initial "on time", the heater control de-energizes the heater for periods of time of increasing length as the temperature of the adhesive increases. The master control enables the operation of the adhesive pump motor when the "off time" of the heater exceeds a predetermined period of time. This predetermined period is selected so that at the corresponding adhesive temperature the adhesive is in a dispensable molten condition.

5 Claims, 3 Drawing Figures

PUMP MOTOR MASTER CONTROL

DESCRIPTION OF THE INVENTION

This invention relates generally to the control of a hot melt adhesive pump motor in a hot melt adhesive system and more particularly concerns a master control for preventing the operation of the motor until the adhesive has reached a dispensable molten state.

Hot melt thermoplastic adhesives are widely used for packaging and cartoning as well as in various forms of product assembly. Typically, the hot melt adhesive is heated in a heating tank and pumped from the tank to be dispensed onto the package or product.

In such hot melt adhesive dispensing systems, the pump is difficult or impossible to operate until the adhesive in the tank and in the pump is heated to a molten condition. Consequently, provision must be made to protect the motor which drives the pump during this period of time that the adhesive is not sufficiently molten to be dispensed by the pump. As will be discussed hereinafter in regard to a particular embodiment of the invention, one type of hot melt adhesive dispensing system is a foamed adhesive dispensing system. While various aspects and advantages of the invention shall be discussed with regard to a particular foamed hot melt adhesive dispensing arrangement, the principles of the invention are applicable to other types of hot melt adhesive dispensing systems which include motor driven adhesive pumps.

In an exemplary foamed hot melt adhesive dispensing system, solid thermoplastic adhesive material is melted in a heated melting tank. A gear pump mixes the molten adhesive with gas from a gas supply which is connected to the pump in order to dispense hot melt adhesive foam. Within the pump, the molten adhesive and gas are thoroughly mixed, and the gas is forced under pump outlet pressure into solution with the molten adhesive. The pressurized molten adhesive and gas solution is then supplied to a dispensing arrangement from which the molten adhesive/gas solution is dispensed at atmospheric pressure.

The melting tank is heated by an electric heater, and the tank in turn heats the solid adhesive material to a molten condition and then maintains the adhesive in that condition. A motor drives the gear pump to dispense the molten adhesive. Typically, between uses of the hot melt adhesive system, the heater and pump motor are de-energized and the molten adhesive returns to its solid form, both in the melting tank and in the gear pump itself. In the past, in order to prevent damage to the pump motor upon restarting the system, a mechanical slip clutch between the motor and the pump has been provided to limit the amount of torque to which the motor might be subjected, such as when there is adhesive in the pump which is in its solid condition. Such a mechanical slip clutch is expensive and subject to wear and performance degradation, which may lead to the need for replacement. Often, the slipping torque level of the clutch mechanism will decrease significantly after use.

An alternative means for protecting the motor during the initial melting of the adhesive would be to prevent the energization of the motor until the hot melt adhesive had reached a dispensable molten condition. However, it is impractical and expensive to measure the temperature of the hot melt adhesive directly for this purpose, such as with a temperature probe. Making such a temperature measurement requires the introduction of the probe into the melting tank area without compromising the integrity of the melting tank. In addition, the longevity and the accuracy of such a temperature probe can be adversely affected due to its direct contact with the adhesive over a period of time. Over a period of use of such a probe there would be temperature variations of the adhesive in the vicinity of the probe with changes by the adhesive between its molten and solid states.

In the exemplary foamed hot melt adhesive dispensing system to be described hereinafter, the melting tank is heated by an electric heater arrangement located within the base of the tank itself. The heat from the tank base and the tank walls is transferred to the adhesive material in the tank and the pump. The melting tank heater is thermostatically controlled by a heater control which compares the temperature of the tank to a threshold temperature, with the heater being energized when the tank temperature falls below the threshold temperature. The temperature of the tank is typically determined from a temperature sensing element located in the base of the tank.

Upon initial startup of the hot melt adhesive system, the electric heater in the base of the tank is energized by the heater control to heat the tank to a limit temperature which is normally somewhat above the threshold temperature. Then the heater is de-energized and the tank cools, partially due to heat transfer to the adhesive material in the tank. Whenever the tank temperature falls below the threshold temperature, the heater is again energized. Therefore, the temperature sensor associated with the thermostatic heater control does not measure the adhesive temperature, but rather the tank temperature.

It is the general aim of the invention to provide a master control for preventing the operation of a hot melt adhesive pump motor, in a hot melt adhesive dispensing system of the foregoing type, until the adhesive has reached a dispensable molten state, without utilizing means to measure the adhesive temperature directly.

In carrying out the invention, advantage is taken of the fact that the "off time" of a thermostatically controlled melting tank heater in a hot melt adhesive dispensing system increases as the temperature of the adhesive material in the tank increases. In an embodiment of the invention, only when the "off time" of the melting tank heater exceeds a predetermined period of time is the adhesive pump motor enabled to drive the pump. The predetermined period of time is selected to correspond to a level of heating of the adhesive material such that the adhesive material is in a dispensable molten condition.

Other objects and advantages of the invention, and the manner of their implementation, will become apparent upon reading the following detailed description and upon reference to the drawings, in which.

Figure 3:
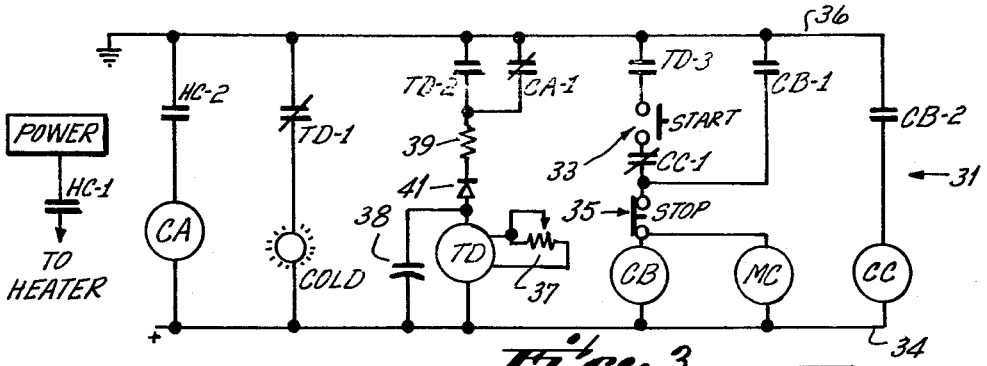
FIG. 3 is a circuit diagram of a master control for a pump motor in accordance with the present invention.

While the invention is susceptible to various modifications and alternative forms, a specific embodiment thereof has been shown by way of example in the drawings and will herein be described in detail. It should be understood, however, that it is not intended to limit the invention to the particular form disclosed, but, on the contrary, the intention is to cover all modifications, equivalents and alternatives falling within the spirit and scope of the invention as defined by the appended claims.

Figure 1:
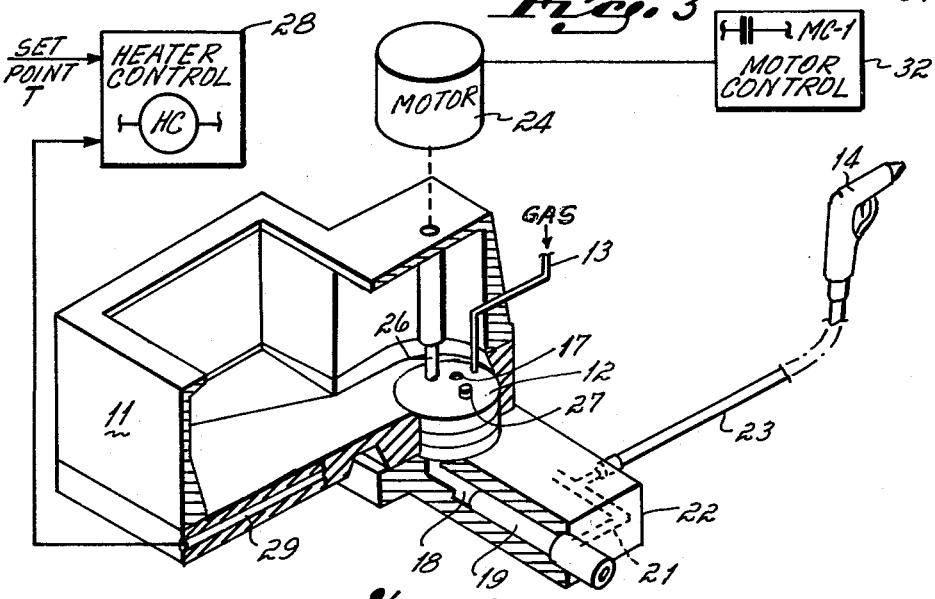
FIG. 1 is a perspective view of a hot melt adhesive dispenser system in conjunction with the heater control and motor control.

Turning now to FIG. 1, a hot melt thermoplastic adhesive foam dispensing apparatus includes a melting tank 11, a gear pump 12, an air or gas supply line 13, and an adhesive dispensing gun 14. Typically, solid thermoplastic adhesive in the form of pellets, blocks, or slugs is placed in the melting tank 11 and melted therein by an electric heating element (not shown) in the base of the melting tank. The heating element may take various forms but typically extends through the base of the tank, including the portion of the base in the vicinity of the pump 12. The molten adhesive flows by gravity to an adhesive inlet port 17 of the pump 12. A low pressure gas, such as air or nitrogen, for example, at a pressure slightly above that of the atmosphere, simultaneously flows from a gas supply through the inlet conduit 13 into the pump 12.

The molten adhesive and the gas flow into the interior of the pump 12 where the intermeshing of teeth of a pair of gears (not shown) cause the molten adhesive and gas to be thoroughly mixed and to be forced under pressure into a molten adhesive/gas solution. The molten adhesive/gas solution then flows from the outlet of the pump 12 through a conduit 18, through a filter 19, into an outlet duct 21 of a manifold block 22, and through a hose 23 to the dispensing gun 14.

In order to drive the gears in the pump 12, a motor 24 is coupled to a drive shaft 26 which drives one of the gears. The other gear shaft 27 is an idler shaft. An exemplary foamed hot melt adhesive dispensing system is illustrated in U.S. Pat. No. 4,059,714, wherein the elements, such as a gear pump, of such a system are described in more detail. Also shown therein is the arrangement of an exemplary housing and control section for a foamed hot melt adhesive system. Since such detailed aspects of a hot melt adhesive system are not critical to the practice of the present invention, they shall not be described further herein.

In the exemplary hot melt adhesive system of FIG. 1, the melting tank heater is controlled by a heater control 28. A threshold setpoint temperature for the heater control 28 is established such as by means of a potentiometer setting. An indication of the actual temperature of the melting tank 11 is also coupled to the heater control 28 from a temperature sensor 29 located within the base of the melting tank 11. The temperature sensor 29 conveniently comprises a capillary bulb type of sensor wherein a liquid expands in response to rising temperature. In operation, when the adhesive system is first turned on, the heater control 28 is activated and compares the tank temperature to the setpoint temperature. The heater control 28 may be viewed as comprising a relay HC. During startup of the system, the tank temperature is well below the setpoint temperature, and the heater control 28 actuates the heater control relay HC. The activation of the relay HC closes the relay contacts HC-1 as shown in FIG. 3, coupling power to the melting tank heater.

Figure 2:
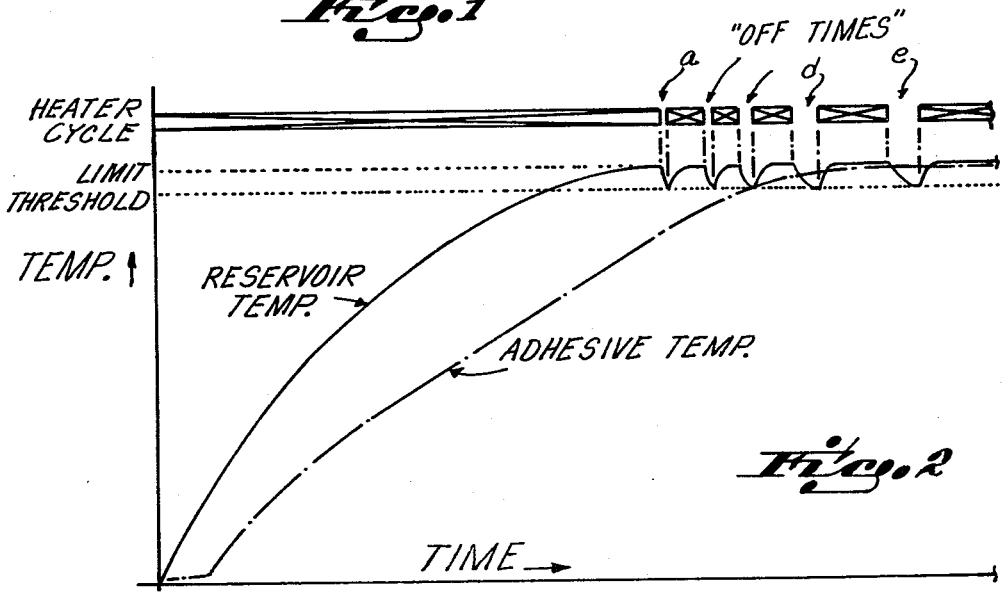
FIG. 2 is a graph illustrating the temperature variations of the adhesive melting tank and the adhesive in the tank over the period of a typical initial warmup cycle.

As illustrated in FIG. 2, the heater control relay HC is activated until the tank temperature reaches a limit temperature. The limit temperature is a certain amount higher than the threshold setpoint temperature, and the limit temperature is the temperature at which the relay HC is de-energized. De-energizing the relay HC opens the relay contacts HC-1, de-energizing the melting tank heater. As the heat from the tank base and walls is transferred to the relatively cooler adhesive material inside the tank 11 (and to the ambient air), the temperature of the tank decreases until it falls to the setpoint threshold temperature. Thereupon the heater control relay HC is again energized, energizing the melting tank heater. This concludes the first "off time" of the heater, identified as "off time" "a" in FIG. 2. As can be seen from FIG. 2, as the temperature differential between the adhesive material and the tank becomes less, due to heating of the adhesive, each "off time" of the heater becomes longer. This is because the rate of heat transfer from the tank 11 to the adhesive material decreases as the temperature differential between them decreases.

In accordance with the invention, an evaluation of the length of the "off time" of the melting tank heater is utilized to set the duration of an initial "lock out" period during which the pump motor 24 is rendered inoperative. The motor 24 remains inoperative until the adhesive has reached a dispensable molten state. In order to do this, a master control circuit 31 receives an indication of the "off time" of the melting tank heater and, in turn, enables the operation of the motor 24 once this "off time" has reached a predetermined length. As can be seen from FIG. 2, the heater "off time" is, in effect, a measure of the adhesive temperature.

The illustrated motor 24 for driving the pump 12 is a dc electric motor, whose speed may be established by a motor control 32 which sets the armature voltage of the motor. Thus, the rate of dispensing of adhesive is controlled by the speed of the pump 12, which is in turn controlled by the speed of the motor 24 under the influence of the motor control 32.

The motor control 32 is disabled, thereby preventing the operation of the motor 24, when a pair of motor control relay contacts MC-1 in the motor control are open. These contacts are controlled by a motor control relay MC in the master control circuit 31 of FIG. 3 in a manner such that the contacts MC-1 remain open until the adhesive has reached a sufficiently molten state to permit operation of the pump 12, as shall be described hereinafter.

In order to begin operation of the hot melt adhesive system, the heater control 28 is energized, and power is applied to the master control circuit 31 as shown in FIG. 3. If a START switch 33 in the master control circuit 31 is momentarily closed, a circuit is completed from the positive bus 34 of the circuit 31, through the motor control relay MC, a normally closed STOP switch 35, a pair of normally closed relay contacts CC-1, and the closed START switch 33, to a pair of normally open contacts TD-3 of a time delay relay TD. One of the TD-3 contacts is connected to a ground bus 36 and the other TD-3 contact is connected to one side of the START switch. In order to complete the circuit for the motor control relay MC, and thus to enable the motor control 32 and the motor 24, the contacts TD-3 must be closed. Therefore, depressing the START switch 33 is ineffective to start the motor until the relay TD is energized.

In order to provide a signal representative of the "off time" status of the melting tank heater to the master control circuit 31, the heater control relay HC controls a second pair of contacts HC-2 which are connected in series with a control relay CA between the power supply and ground buses 34 and 36, respectively. The control relay CA in turn controls a pair of contacts CA-1 coupled in series with the time delay relay TD between the buses 34 and 36. It is this time delay relay TD that performs the function of distinguishing the lengths of the "off times" of the melting tank heater.

The contacts CA-1 are normally closed, and they are opened when the relay CA is energized. The relay CA is energized whenever the melting tank heater is energized, since at this time both the contacts HC-1 and HC-2 (in series with the relay CA) are closed. Consequently, the contacts CA-1 are closed during the "off time" of the melting tank heater. Therefore, during the heater "off time" the time delay relay TD is coupled across the buses 34 and 36.

The time delay relay TD controls three sets of contacts, TD-1, TD-2, and TD-3. However, the time delay relay is not immediately energized to control these contacts in response to being coupled across the buses 34 and 36. Instead, the relay TD activates its controlled contacts only after it has been energized for a predetermined period of time. This period of time is established by the setting of a potentiometer 37 coupled to the relay. The proper predetermined time setting is obtained by determining the necessary length of "off time" of the melting tank heater necessary to correspond to a suitably high adhesive temperature. The adhesive temperature must be high enough to ensure that the adhesive is in a dispensable molten condition to permit free operation of the pump 12.

As was discussed previously in regard to the graph of FIG. 2, each "off time" for the melting tank heater becomes longer as the temperature of the adhesive increases. Thus, the potentiometer 37 is set to establish a delay time for the relay TD which corresponds to an appropriate "off time" for the melting tank heater. This appropriate "off time" occurs when the adhesive temperature is high enough to ensure that the adhesive is sufficiently molten to allow free operation of the pump 12. From data for the heater "off time" versus adhesive temperature, as illustrated in FIG. 2, the proper time can be readily selected for a given hot melt adhesive system. For example, from the FIG. 2 data, a critical time duration might be selected at a value between that of the "off time" "d" and the "off time" "e". As illustrated, by such a time the adhesive temperature has almost reached the limit temperature of the tank.

If a heater "off time" duration is less than the time delay which is established for the relay TD, the relay contacts CA-1 will open before the time delay relay is energized. Therefore, the time delay relay will not be energized until a subsequent, longer, "off time" of the melting tank heater.

When the adhesive is sufficiently heated that the "off time" of the melting tank heater exceeds the predetermined delay time for the time delay relay TD, the relay TD is energized, actuating its three sets of controlled contacts. The contacts TD-1, which had been normally closed to energize a COLD light indicating that the adhesive had not yet been heated to a dispensable temperature, open to de-energize the COLD light.

The time delay relay contacts TD-2, which are connected in parallel with the contacts CA-1, close, thereby latching on the time delay relay TD. Therefore, subsequent fluctuations in the heater control cycles will not affect the time delay relay TD after the initial startup of the adhesive dispensing system.

The normally open time delay relay contacts TD-3 close when the relay TD is energized, completing the circuit between the buses 34 and 36 for the motor control relay MC when the START switch 33 is depressed. Thus, when the START switch is closed after the activation of the relay TD, the motor control 32 is enabled by the closing of the contacts MC-1, and the motor 24 is permitted to operate under the control of the motor control 32.

At the same time that the motor control relay MC is energized, a control relay CB is also energized, which closes its controlled contacts CB-1 and CB-2. Closing the contacts CB-1 establishes a conductive path between the buses 34 and 36 through the contacts CB-1, the normally closed STOP switch, and the control relay CB. Closing the contacts CB-2 energizes another control relay CC, which in turn opens the normally closed contacts CC-1 between the START and STOP switches 33 and 35. This decouples the START switch 33 from the circuit, but since the now-closed CB-1 path bypasses the now-open CC-1 contacts, the relays CB and MC remain energized.

The operation of the master control circuit 31 when the adhesive dispensing system is turned off is as follows. When the STOP switch 35 is depressed, opening the STOP switch, the motor control relay MC deactuates the motor control 32, and hence the motor 24. In addition, the control relay CB is de-energized, opening the contacts CB-1 and CB-2. Opening the contacts CB-2 de-energizes the controlled relay CC, reclosing the contacts CC-1. Opening the contacts CB-1 maintains the relays CB and MC in a de-energized condition even after the release of the stop switch 35 and its consequent reclosing. The time delay relay TD remains latched on through its contacts TD-2, however, and therefore, the motor control 32 will again be activated if the START switch 33 is closed, regardless of the cycle times of the heater control 28. The circuit path between the buses 34 and 36 for this re-START condition is through the closed TD-3 contacts, the START switch 33, the closed contacts CC-1, the STOP switch 35, and the motor control relay MC. In this way, the motor 24 and the pump 12 may be started and stopped after initial warmup using the switches 33 and 35 without the need to wait for an appropriate heater "off time".

When the adhesive dispensing system as a whole is turned off, the power to the circuit 31 is removed, and the heater control 28 is also de-energized. When the power is removed from the master control circuit 31, the relay TD unlatches. Subsequent turning on of the adhesive dispensing system requires the occurrence of a heater "off time" exceeding the predetermined "off time" in order to relatch the relay TD and enable the motor 24.

The capacitor 38, resistor 39, and diode 41 associated with the time delay relay TD are provided for filtering and the suppression of transient waveforms. In the present case, the motor 24 in the hot melt adhesive dispensing system is a dc electric motor whose speed is adjusted by a motor control 32. Pneumatic drive motors, for example, are also used to drive adhesive dispensing pumps such as the pump 12. The principles of the present invention would also be applicable to such a pneumatic motor. The pneumatic drive to the motor in such a case could be disabled in a manner similar to that presently disclosed in which the electric motor control 32 is disabled.

What is claimed is:

1. In a hot melt adhesive dispensing arrangement having an adhesive tank, a heater for heating the tank, a pump for pumping molten adhesive from the tank, and a motor for driving the pump, a master control for preventing the operation of the motor until the adhesive has reached a dispensable molten state comprising:

a master control circuit having an input and having means for enabling the operation of the motor in response to the presence of a condition at the input for a finite delay interval equal to a predetermined period of time;

means for sensing the temperature of the tank;

a heater control coupled to the temperature sensing means and to the heater and operable to energize the heater when the temperature of the tank falls below a predetermined temperature; and means for producing said condition at the input of the master control circuit when the heater is not energized, whereby, as the adhesive is heated by the tank and each period of time during which the heater is not energized increases in duration, said predetermined period of time is reached and the operation of the motor is enabled.

2. The master control of claim 1 in which the master control circuit includes a time delay relay which is energized when said condition is present at the input of the master control circuit for said predetermined period of time.

3. The master control of claim 2 in which the master control circuit further comprises a first control relay which is de-energized when said condition is present at the master control circuit input, the first control relay having controlled contacts which are operable to energize the time delay relay when the first control relay is de-energized.

4. The master control of any of claims 1, 2 or 3 in which the motor is a dc electric motor and further comprising a motor control for controlling the speed of the dc motor, the motor control being energized to enable the operation of the motor by the enabling means of the master control circuit.

5. In a hot melt adhesive dispensing arrangement having an adhesive tank, a heater for heating the tank, a pump for pumping molten adhesive from the tank, and a motor for driving the pump, a master control for preventing the operation of the motor until the adhesive has reached a dispensable molten state comprising:

time delay means having an input for producing a control signal at an output in response to the presence of a condition at the input for a finite delay interval equal to a predetermined period of time;

a master control circuit coupled to the output of the time delay means and having means for enabling the operation of the motor in response to said control signal;

means for sensing the temperature of the tank;

a heater control coupled to the temperature sensing means and to the heater and operable to energize the heater when the temperature of the tank falls below a predetermined temperature; and means for producing said condition at the input of the time delay means when the heater is not energized, whereby, as the adhesive is heated by the tank and each period of time during which the heater is not energized increases in duration, said predetermined period of time is reached and the operation of the motor is enabled.

* * * * *